US007568885B2

(12) United States Patent
Parker et al.

(10) Patent No.: US 7,568,885 B2
(45) Date of Patent: Aug. 4, 2009

(54) HIGH EFFICIENCY AIR CONDITIONER CONDENSER FAN

(75) Inventors: Danny S. Parker, Cocoa Beach, FL (US); John Sherwin, Cocoa Beach, FL (US); Bart Hibbs, Monrovia, CA (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 769 days.

(21) Appl. No.: 11/207,501

(22) Filed: Aug. 19, 2005

(65) Prior Publication Data

US 2005/0281672 A1 Dec. 22, 2005

Related U.S. Application Data

(62) Division of application No. 10/400,888, filed on Mar. 27, 2003, now Pat. No. 7,014,423.

(60) Provisional application No. 60/369,050, filed on Mar. 30, 2002, provisional application No. 60/438,035, filed on Jan. 3, 2003.

(51) Int. Cl.
*F04D 1/04* (2006.01)

(52) U.S. Cl. ..... 415/221; 415/220

(58) Field of Classification Search ..... 415/4.4, 415/207, 218.1, 219.1, 222
See application file for complete search history.

(56) References Cited

U.S. PATENT DOCUMENTS 2,022,417 A * 11/1935 Gilbert et al. ..... 416/95
2,638,757 A 5/1953 Borgerd ..... 62/140
3,995,442 A 12/1976 Cavezza ..... 62/259

(Continued)

OTHER PUBLICATIONS

Kernstock, Slashing Through the Noise Barrier, *Defense Daily Network—Rotor & Wing's Cover Story*, Aug. 1999, p. 1-11.

*Primary Examiner*—Thomas E Denion
*Assistant Examiner*—Christopher Jetton
(74) *Attorney, Agent, or Firm*—Brian S. Steinberger; Law Offices of Brian S. Steinberger, P.A.

(57) ABSTRACT

Novel twisted blades with an air foil for use with air conditioner condensers and heat pumps that provide improved airflow efficiency to minimize operating power requirements having an overall diameter across the blades being approximately 19 inches, and approximately 27.6 inches. The blades (AC-A) can run at approximately 840 rpm to produce approximately 2200 cfm of air flow using approximately 110 Watts of power from an 8-pole motor. Using an OEM 6-pole ⅛ hp motor produced approximately 2800 cfm with approximately 144 Watts of power while running the blades at approximately 1100 rpm. Power savings were 25% (50 W) over the conventional configuration. A second version of the fan (AC-B) with some refinements to the flow geometry produced a similar air flow while using only 131 W of power at 1100 rpm. Power savings were 32% (62 W) over the conventional configuration. Embodiments can include two, three, four and five blades equally spaced apart from one another about hubs. Additionally, a novel noise reduction configuration can include asymmetrically mounted blades such as five blades asymmetrically mounted about the hub. Short, conical diffusers were shown to further improve air moving performance by up to 18% at no increase in power. Embodiments coupled with electronically commutated motors (ECMs) showed additional reductions to condenser fan power of approximately 20%.

8 Claims, 10 Drawing Sheets

U.S. PATENT DOCUMENTS

| | | | | | |
|---|---|---|---|---|---|
| 4,010,932 | A | * | 3/1977 | Otto | 366/70 |
| 4,275,785 | A | | 6/1981 | Kerivan | 165/183 |
| 4,470,271 | A | | 9/1984 | Draper | 62/259.1 |
| 4,526,506 | A | | 7/1985 | Koger | 415/98 |
| 4,971,143 | A | | 11/1990 | Hogan | 165/122 |
| 4,971,520 | A | | 11/1990 | Van Houten | 416/169 |
| 5,255,529 | A | | 10/1993 | Powell et al. | 62/180 |
| 5,320,493 | A | | 6/1994 | Shih | 416/223 |
| 5,624,234 | A | | 4/1997 | Neely | 416/238 |
| 5,695,318 | A | * | 12/1997 | Harmsen | 415/218.1 |
| 5,803,709 | A | * | 9/1998 | Matthews et al. | 415/182.1 |
| 5,809,800 | A | | 9/1998 | Deal | 62/507 |
| 6,037,725 | A | | 3/2000 | Tolbert, Jr. | 318/110 |
| 6,129,528 | A | * | 10/2000 | Bradbury et al. | 417/423.1 |
| 6,172,476 | B1 | | 1/2001 | Tolbert et al. | 318/772 |
| 6,185,954 | B1 | | 2/2001 | Smiley | 62/426 |
| 6,210,118 | B1 | | 4/2001 | Egawa et al. | 416/243 |

* cited by examiner

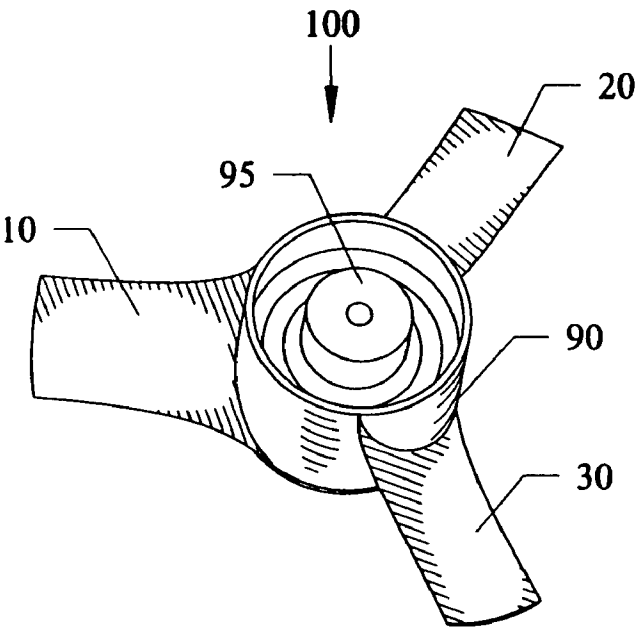
FIG. 6
FIG. 4
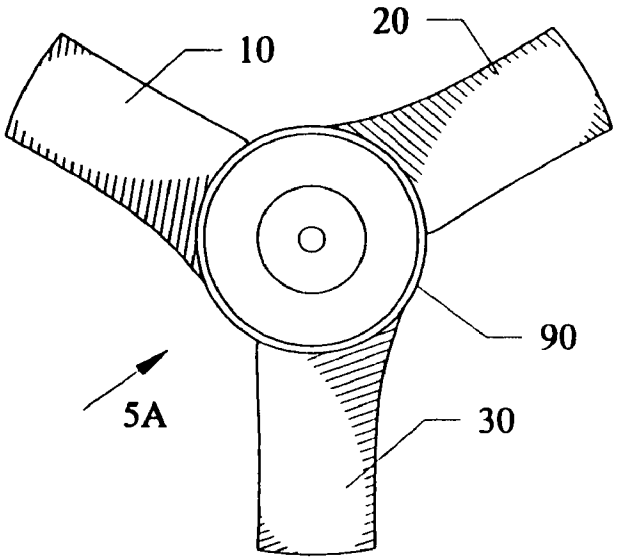
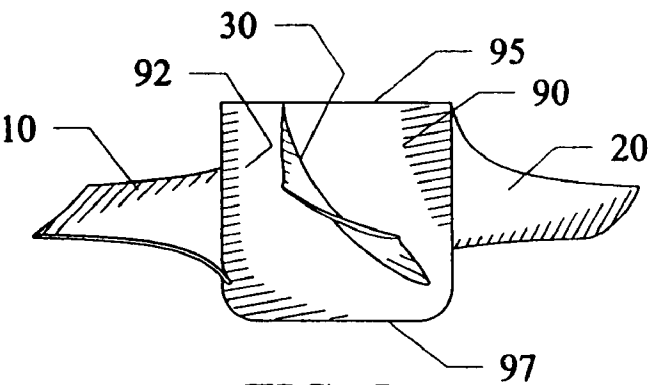
FIG. 5

FIG. 7
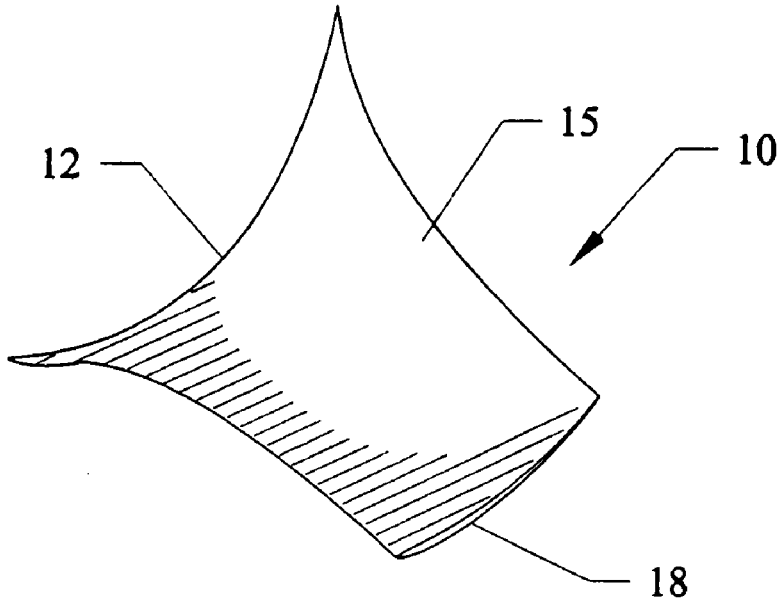
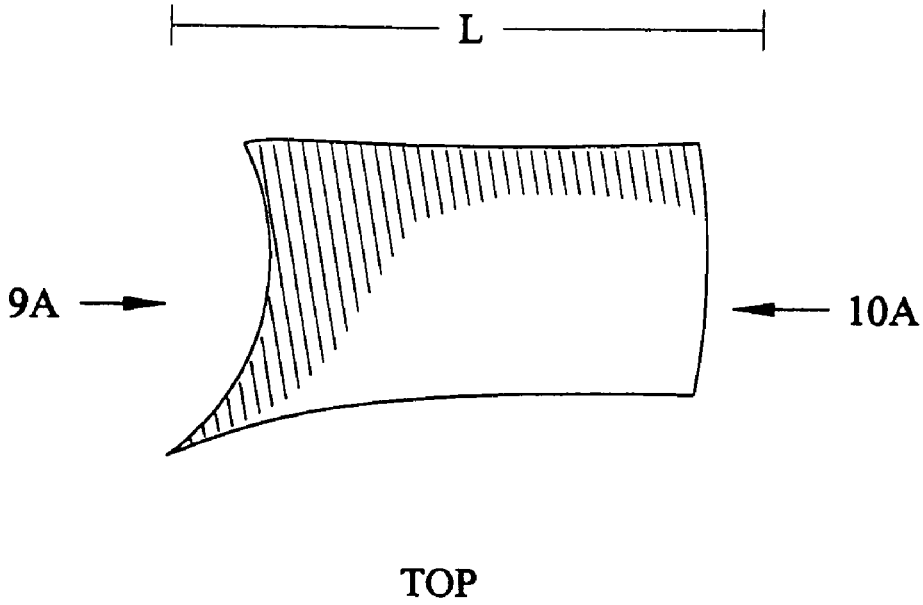
FIG. 8

HIGH EFFICIENCY AIR CONDITIONER CONDENSER FAN

This invention is a divisional application of U.S. patent application Ser. No. 10/400,888 filed Mar. 27, 2003, now U.S. Pat. No. 7,014,423, which claims the benefit of priority to U.S. Provisional Application 60/369,050 filed Mar. 30, 2002 and 60/438,035 filed Jan. 3, 2003.

FIELD OF INVENTION

This invention relates to air conditioning systems and heat pumps, and in particular to using diffuser shaped housings and/or asymmetrical mounted blades airflow and/or reduce decibel(dB) levels.

BACKGROUND AND PRIOR ART

Central air conditioning (AC) systems typically rely on using utilitarian stamped metal fan blade designs for use with the outdoor air conditioning condenser in a very large and growing marketplace. In 1997 alone approximately five million central air conditioning units were sold in the United States, with each unit costing between approximately $2,000 to approximately $6,000 for a total cost of approximately $15,000,000,000(fifteen billion dollars). Conventional condenser fan blades typically have an air moving efficiency of approximately 25%. For conventional three-ton air conditioners, the outdoor fan power is typically 200-250 Watts which produces approximately 2000-3000 cfm of air flow at an approximately 0.1 inch water column (IWC) head pressure across the fan. The conventional fan system requires unnecessarily large amounts of power to achieve any substantial improvements in air flow and distribution efficiency. Other problems also exist with conventional condensers include noisy operation with the conventional fan blade designs that can disturb home owners and neighbors.

Air-cooled condensers, as commonly used in residential air conditioning systems, employ finned-tube construction to transfer heat from the refrigerant to the outdoor air. As hot, high pressure refrigerant passes through the coil, heat in the compressed refrigerant is transferred through the tubes to the attached fins. Electrically powered fans are then used to draw large quantities of outside air across the finned heat transfer surfaces to remove heat from the refrigerant so that it will be condensed and partially sub-cooled prior to its reaching the expansion valve.

Conventional AC condenser blades under the prior art are shown in FIGS. 1-3, which can include metal planar shaped blades 2, 4, 6 fastened by rivets, solder, welds, screws, and the like, to arms 3, 5, and 7 of a central condenser base portion 8, where the individual planar blades(4 for example) can be entirely angle oriented.

The outside air conditioner fan is one energy consuming component of a residential air conditioning system. The largest energy use of the air conditioner is the compressor. Intensive research efforts has examined improvements to it performance. However, little effort has examined potential improvements to the system fans. These include both the indoor unit fan and that of the outdoor condenser unit.

Heat transfer to the outdoors with conventional fans is adequate, but power requirements are unnecessarily high. An air conditioner outdoor fan draws a large quantity of air at a very low static pressure of approximately 0.05 to 0.15 inches of water column (IWC) through the condenser coil surfaces and fins. A typical 3-ton air conditioner with a seasonal energy efficiency ratio (SEER) of 10 Btu/W moves about 2500 cfm of air using about 250 Watts of motor power. The conventional outdoor fan and motors combination is a axial propeller type fan with a fan efficiency of approximately 20% to approximately 25% and a permanent split capacitor motor with a motor efficiency of approximately 50% to approximately 60%, where motor efficiency is the input energy which the motor converts to useful shaft torque, and where fan efficiency is the percentage of shaft torque which the fan converts to air movement.

In conventional systems, a ⅛ hp motor would be used for a three ton air conditioner (approximately 94 W of shaft power). The combined electrical air "pumping efficiency" is only approximately 10 to approximately 15%. Lower condenser fan electrical use is now available in higher efficiency AC units. Some of these now use electronically commutated motors (ECMs) and larger propellers. These have the capacity to improve the overall air moving efficiency, but by about 20% at high speed or less. Although more efficient ECM motors are available, these are quite expensive. For instance a standard ⅛ hp permanent split capacitor (PSC) condenser fan motor can cost approximately $25 wholesale whereas a similar more efficient ECM motor might cost approximately $135. Thus, from the above there exists the need for improvements to be made to the outdoor unit propeller design as well as for a reduction to the external static pressure resistance of the fan coil unit which can have large impacts on potential air moving efficiency.

Over the past several years, a number of studies have examined various aspects of air conditioner condenser performance, but little examining specific improvements to the outdoor fan unit. One study identified using larger condenser fans as potentially improving the air moving efficiency by a few percent. See J. Proctor, and D. Parker (2001). "Hidden Power Drains: Trends in Residential Heating and Cooling Fan Watt Power Demand," *Proceedings of the* 2000 *Summer Study on Energy Efficiency in Buildings*, Vol. 1, p. 225, ACEEE, Washington, D.C. This study also identified the need to look into more efficient fan blade designs, although did not undertake that work. Thus, there is an identified need to examine improved fan blades for outdoor air conditioning units.

Currently, major air conditioner manufacturers are involved in efforts to eliminate every watt from conventional air conditioners in an attempt to increase cooling system efficiency in the most cost effective manner. The prime pieces of energy using equipment in air conditioners are the compressor and the indoor and outdoor fans.

Conventional fan blades used in most AC condensers are stamped metal blades which are cheap to manufacture, but are not optimized in terms of providing maximum air flow at minimum input motor power. Again, FIGS. 1-3 shows conventional stamped metal condenser fan blades that are typically used with typical outdoor air conditioner condensers such as a 3 ton condenser.

In operation, a typical 3 ton condenser fan from a major U.S. manufacturer draws approximately 195 Watts for a system that draws approximately 3,000 Watts overall at the ARI 95/80/67 test condition. Thus, potentially cutting the outdoor fan energy use by approximately 30% to 50% can improve air conditioner energy efficiency by approximately 2% to 3% and directly cut electric power use.

Residential air conditioners are a major energy using appliance in U.S. households. Moreover, the saturation of households using this equipment has dramatically changed over the last two decades. For instance, in 1978, approximately 56% of U.S. households had air conditioning as opposed to approximately 73% in 1997 (DOE/EIA, 1999). The efficiency of residential air conditioner has large impacts on utility summer peak demand.

Various information on typical air conditioner condenser systems can be found in references that include:

DOE/EIA, 1999. *A Look at Residential Energy Consumption in* 1997, Energy Information Administration, DOE/EIA-0632 (97), Washington, D.C.

Parker, D. S., J. R. Sherwin, R. A. Raustad and D. B. Shirey III. 1997, "Impact of Evaporator Coil Air Flow in Residential Air Conditioning Systems," *ASHRAE Transactions*, Summer Meeting, Jun. 23-Jul. 2, 1997, Boston, Mass.

J. Proctor and D. Parker (2001). "Hidden Power Drains: Trends in Residential Heating and Cooling Fan Watt Power Demand," *Proceedings of the* 2000 *Summer Study on Energy Efficiency in Buildings*, Vol.1, p. 225, ACEEE, Washington, D.C.

J. Proctor, Z. Katsnelson, Peterson and A. Edminster, *Investigation of Peak Electric Load Impacts of High SEER Residential HVAC Units*, Pacific Gas and Electric Company, San Francisco, Calif., September, 1994.

Many patents have been proposed over the years for using fan blades but fail to deal with specific issues for making the air conditioner condenser fans more efficient for flow over the typical motor rotational speeds. See U.S. Pat. No. 4,526,506 to Kroger et al.; U.S. Pat. No. 4,971,520 to Houten; U.S. Pat. No. 5,320,493 to Shih et al.; U.S. Pat. No. 6,129,528 to Bradbury et al.; and U.S. Pat. No. 5,624,234 to Neely et al.

Although the radial blades in Kroger '506 have an airfoil, they are backward curved blades mounted on an impeller, typically used with a centrifugal fan design typically to work against higher external static pressures. This is very different from the more conventional axial propeller design in the intended invention which operates against very low external static pressure (0.05-0.15 inches water column—IWC).

Referring to Houten '520, their axial fan describes twist and taper to the blades, and incorporates a plurality of blades attached to an impeller, rather than a standard hub based propeller design. This impeller is not optimal for standard outdoor air conditioning systems as it assumes its performance will be best when it is heavily loaded and is located very close to the heat exchanger (as noted in "Structure and Operation", Section 50). In a standard residential outdoor air conditioner, the fan is located considerably above the heat exchange surfaces and the fan operates in a low-load condition under low external static pressure. This distinction is clear in FIG. 1 of the Houten apparatus where it is intended that the fan operate immediately in front of the heat exchange surface as with an automobile air conditioning condenser (see High Efficiency Fan, 1, last paragraph). The blades also do not feature a true air foil with a sharp trailing edge shown in FIG. 4A-4B.

Referring to Shih et al. '493, the axial fan describes features twisted blades, but are designed for lower air flow and a lower as would be necessary for quietly cooling of office automation systems. Such a design would not be appropriate for application for air condition condenser fan where much large volumes of air (e.g. 2500 cfm) must be moved at fan rotational velocities of 825-1100 rpm. The low air flow parameters and small air flow produced are clearly indicated in their "Detailed Description of the Invention." The speed and air flow requirements for residential air conditioning condensers require a considerably different design for optimal air moving performance.

Referring to Bradbury '528, that device encompasses an axial fan designed to effectively cool electronic components in a quiet manner. The fans feature effective air foils, but the specific blade shape, chord, taper and twist are not optimized for the specific requirements for residential air conditioning condensers (825-1100 rpm with 2000-4800 cfm of air flow against low static pressures of 0.10-0.15 IWC) Thus, the cross sectional shapes and general design of this device are not relevant to the requirements for effective fans for air conditioner condensers. The limitations of Bradbury are clearly outlined in Section 7, 40 where the applicable flow rates are only 225 to 255 cfm and the rotational rates are 3200 to 3600 rpm. By contrast, the residential air conditioner condenser fans in the proposed invention can produce approximately 2500 to approximately 4500 cfm at rotational velocities of approximately 825 to approximately 1100 rpm The Neely '234 patented device consists of an axial fan designed for vehicle engine cooling. Although its blades include a twisted design and airfoil mounted on a ring impeller, it does not feature other primary features which distinguished the proposed invention. These are a tapered propeller design optimized for an 825-1100 RPM fan speed and for moving large quantities of air (2000-2500 cfm) at low external static pressure. As with the prior art by Houten, the main use for this invention would be for radiator of other similar cooling with an immediately adjacent heat exchanger. The Neely device is optimized for higher rotational speeds (1900-2000 rpm) which would be too noisy for outdoor air conditioner condenser fan application (see Table 1). It also does not achieve sufficient flow as the Neely device produces a flow of 24.6-25.7 cubic meters per minute or 868 to 907 cfm —only half of the required flow for a typical residential air conditioner condenser (Table 1). Thus, the Neely device would not be use relevant for condenser fan designs which need optimization of the blade characteristics (taper, twist and airfoil) for the flow (approximately 2500 to approximately 4500 cfm) and rotational requirements of approximately 825 to approximately 1100 rpm.

The prior art air conditioning condenser systems and condenser blades do not consistently provide for saving energy at all times when the air conditioning system operates and do not provide dependable electric load reduction under peak conditions.

Thus, improved efficiency of air conditioning condenser systems would be both desirable for consumers as well as for electric utilities.

SUMMARY OF THE INVENTION

A primary objective of the invention is to provide condenser fan blades for air conditioner condenser or heat pump systems that saves energy at all times when the air conditioning system operates and provides dependable electric load reduction under peak conditions.

A secondary objective of the invention is to provide condenser fan blades for air conditioner condenser or heat pump systems that would be both desirable for both consumers as well as for electric utilities.

A third objective of the invention is to provide air conditioner condenser blades that increase air flow and energy efficiencies over conventional blades.

A fourth objective of the invention is to provide air conditioner condenser blades for air conditioning systems or heat pumps that can be made from molded plastic, and the like, rather than stamped metal.

A fifth objective of the invention is to provide for operating air conditioner condenser or heat pump fan blades at approximately 825 rpm to produce airflow of approximately 2000 cfm using approximately 110 Watts of power.

A sixth objective of the invention is to provide a condenser or heat pump fan blade that improves air flow air moving efficiencies by approximately 30% or more over conventional blades.

A seventh objective of the invention is to provide a condenser or heat pump fan blade that uses less power than conventional condenser motors.

An eighth objective of the invention is to provide a condenser or heat pump fan blade that allows for more quiet outdoor operation than conventional condenser or heat pump fans.

A ninth objective of the invention is to provide a condenser fan blade or heat pump assembly which aids heat transfer to the air conditioner condenser that rejects heat to the outdoors.

A tenth objective of the invention is to provide a condenser or heat pump fan blade assembly that provides demonstrable improvements to space cooling efficiency.

An eleventh objective of the invention is to provide a condenser or heat pump fan assembly that has measurable electric load reduction impacts on AC system performance under peak demand conditions.

A twelfth objective of the invention is two diffuser designs to reduce back pressure on the condenser fan to further improve air moving performance. Tests showed short conical exhaust diffuser can improve air moving efficiency by a further approximately 18% (approximately 400 cfm) over a conventional "starburst" exhaust grill.

A thirteenth objective is to provide air conditioner condenser fan blades having an asymmetrical configuration to achieve lower sound levels due to its altered frequency resonance, thus having reduced noise effects over conventional configurations The invention includes embodiments for both an approximately nineteen-inch tip to tip condenser fan blade system, and an approximately 27 inch tip to tip condenser fan blade system. The higher efficiency fan produces a fan blade shape that will fit in conventional AC condensers (approximately 19 inches wide for a standard three-ton condenser and approximately 27 inches wide for a higher efficiency model). The tested 19 inch fan provides an airflow of approximately 840 rpm to produce approximately 2200 cfm of air flow at approximately 110 Watts using a 8-pole motor.

Using an OEM 6-pole ⅛ hp motor produced approximately 2800 cfm with approximately 130 Watts of power while running the blades at approximately 1100 rpm.

Asymmetrical air conditioner condenser fan blades are also described that can reduce noise effects over conventional air conditioner condenser or heat pump fan blades. A preferred embodiment shows at least an approximate 1 dB reduction using a five blade assymetrical configuration.

Novel diffuser housing configurations can include conical housings and rounded surfaces for reducing backpressure problems over the prior art.

Further objects and advantages of this invention will be apparent from the following detailed description of presently preferred embodiments which are illustrated schematically in the accompanying drawings.

BRIEF DESCRIPTION OF THE FIGURES

FIG. 4 is a bottom perspective view of a first preferred embodiment of a three condenser blade assembly of the invention.

FIG. 5 is a side view of the three blade assembly of FIG. 4 along arrow 5A.

FIG. 6 is a perspective view of the three blade assembly of FIGS. 4-5.

FIG. 7 is a perspective view of a single twisted condenser blade for the assembly of FIGS. 1-3 for a single blade used in the 19" blade assemblies.

FIG. 8 is a top view of a single novel condenser blade of FIG. 7.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
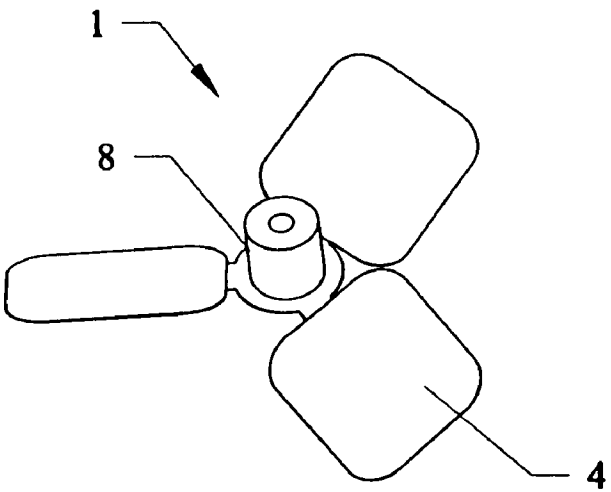
FIG. 1 (PRIOR ART)
FIG. 1 is a perspective view of a prior condenser blade assembly.
Figure 2:
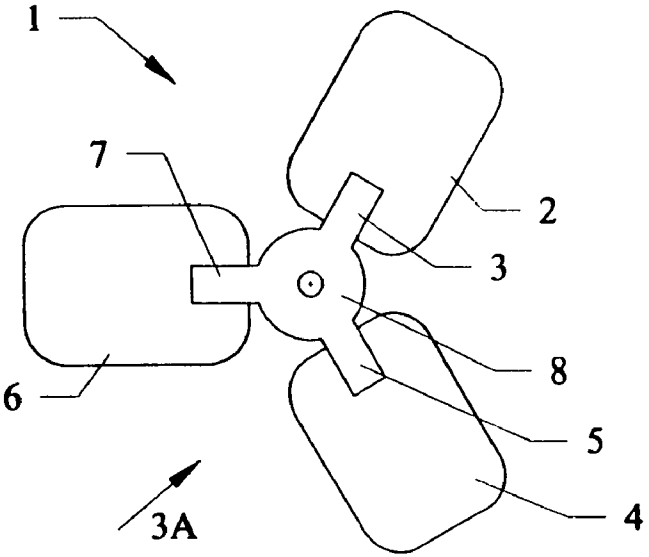
FIG. 2 (PRIOR ART)
FIG. 2 is a top view of the prior art condenser blade assembly of FIG. 1.
Figure 3:
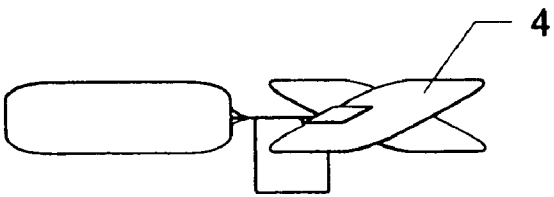
FIG. 3 (PRIOR ART)
FIG. 3 is a side view of the prior art condenser blade assembly of FIG. 2 along arrow 3A.

Unlike the flat planar stamped metal blades that are prevalent in the prior art as shown in FIGS. 1-3, the subject invention can have molded blades that can be twisted such as those formed from molded plastic, and the like.

Novel fan blades attached to a condenser hub can have the novel blades run at approximately 840 rpm producing approximately 2200 cfm of air flow and 2800 cfm at 1100 rpm.

These results come only from an improved fan system and generally requires no change in the tooling of non-fan components for the condenser. We used the original fan motor to demonstrate the power savings, although greater savings are available under non-peak conditions though the use of an 8-pole motor running at approximately 840 rpm which will produce approximately 2200 cfm of air flow at approximately 110 Watts.

The standard stamped metal blades in as shown in the prior art of FIGS. 1-3 can produce approximately 2800 cfm with approximately 193 Watts of power at approximately 1050 rpm.

The improved fan of the invention with exactly the same OEM 6-pole ⅛ hp PSC motor produced approximately 2800 cfm with approximately 131 Watts of power at approximately 1100 rpm. Direct power savings are approximately 62 Watts (an approximately 32% drop in outdoor unit fan power). The improvement in air moving efficiency was approximately 48%: approximately 21.4 cfm/W against approximately 14.5 cfm/W for the standard fan.

Our tests showed that the novel fan blades can also be slowed from approximately 1100 to approximately 840rpm and still produce approximately 2200 cfm of air flow with only approximately 110 Watts, an approximately 51% reduction in fan power for non-peak conditions. The lower rpm range results in substantially quieter fan operation.

For a typical 3-ton heat pump, total system power (compressor, indoor and outdoor fans) would typically drop from approximately 3,000 Watts at design condition (95 O.D., 80,67 IDB/IWB) to approximately 2940 Watts with the new fan, an approximately 2% reduction in total cooling power. For a typical heat pump consumer with approximately 2,000 full load hours per year, this would represent an approximate $10 savings annually. The fabrication of the fan assembly is potentially similar to fabricated metal blades so that the payback could be virtually immediate. Additionally, the condenser fan motor can also be less loaded than with the current configuration improving the motor life and reliability.

Thus, the invention achieves a design with a significant performance improvement that can be readily adaptable to use within current lines of unitary air conditioners to cut outdoor AC unit fan power by approximately 25 to approximately 32% or more over standard condenser fan blade assemblies.

The novel invention embodiments can provide power savings with little change or no change in the cost of the fans and also provide substantially better flow at low speed operation which is something the better motors cannot provide.

FIG. 4 is a bottom perspective view of a first preferred embodiment of a three condenser blade assembly 100 of the invention. FIG. 5 is a side view of the three blade assembly 100 of FIG. 4 along arrow 5A. FIG. 6 is a perspective view of the three blade assembly 100 of FIGS. 4-5.

Referring to FIGS. 4-6, a central hub 90 can include a bottom end 95 for attaching the assembly 100 to standard or novel condenser housing which will be described later in reference to FIGS. 19-23. The central hub can include a top end and sides 92 on which three novel twisted blades 10, 20, 30 can be mounted in an equally spaced configuration thereon. For example, the blades can be spaced approximately 120 degrees apart from one another. The blades 10, 20, 30 can be separately molded and later fastened to the hub 90 by conventional fasteners as described in the prior art. Alternatively, both the novel blades 10, 20, 30 and hub 90 can be molded together into the three blade assembly 100.

Table 1 shows the comparative performance of the novel condenser fan 19" blades AC-A@, AC-B@, and 27.6" blades AC-C@ compared to standard 19" and 27.6" condenser fans.

TABLE 1

Comparative Performance of Air Conditioner Fans Against Conventional Models (External Fan Static Pressure = ~0.15 IWC; Fan motor efficiency = 60%)

High Speed

| | Small Std. | Novel AC-AA@ | Novel AC-AB@ | Std. Large | Novel AC AD@[2] |
|---|---|---|---|---|---|
| Size | 19" | 19" | 19" | 27.6" | 27.6" |
| HP | ⅛ hp | ⅛ hp | ⅛ hp | ⅛ hp | ⅛ hp |
| RPM | 1,050 | 1,110 | 1,130 | 820 | 860 |
| CFM | 2,820 | 2,810 | 2,800 | 4,500 | 4,500 |
| Watts | 194 | 144 | 131 | 225 | 170 |
| CFM/W | 14.5 | 19.5 | 21.4 | 20.0 | 26.5 |
| $DB_1$ | 73.0 | 74.5 | 74.5 | 71.0 | na |

Low Speed

| | Novel AC-AA@ | Novel AC-AB@ | Novel AC-AC@[3] |
|---|---|---|---|
| Size | 19" | 19" | 19" |
| HP | ⅛ hp | ⅛ hp | ⅛ hp |
| RPM | 870 | 870 | 700 |
| CFM | 2,090 | 2,190 | 2,580 |
| Watts | 112 | 109 | 135 |
| CFM/W | 18.7 | 20.1 | 19.1 |
| dB | 72.0 | 72.0 | 71.0 |

[1]Calibrated sound pressure measurement at 4 ft. distance to condenser, AC@weighting; condenser fan only
[2]Simulated performance, shaft power is 72 W against a condenser housing pressure rise of 33 Pa
[3]5-bladed asymmetrical design
High Speed uses a six pole motor and corresponds to a speed of 1050-1100 RPM.
Low Speed corresponds to a speed of 830-870 RPM.
HP is horsepower
RPM is revolutions per minute
CFM is cubic feet per minute
Watts is power
CFM/W is cubic feet per minute per watts
dB is decibels of sound pressure measured over a one minute period at a four foot distance Fan AC-A and AC-B differ in their specific fan geometry. Fan B is designed for a higher pressure rise than Fan AC-A. Fan AC-B exhibits better performance with conventional condenser exhaust tops. Fran AC-A, is. designed for lower pressure rise, showed that it may perform better when coupled to a conical diffuser exhaust.

Fan "AC-C@" is a five-bladed asymmetrical version of the Fan A blades, designed to lower ambient sound levels.

Figure 10:
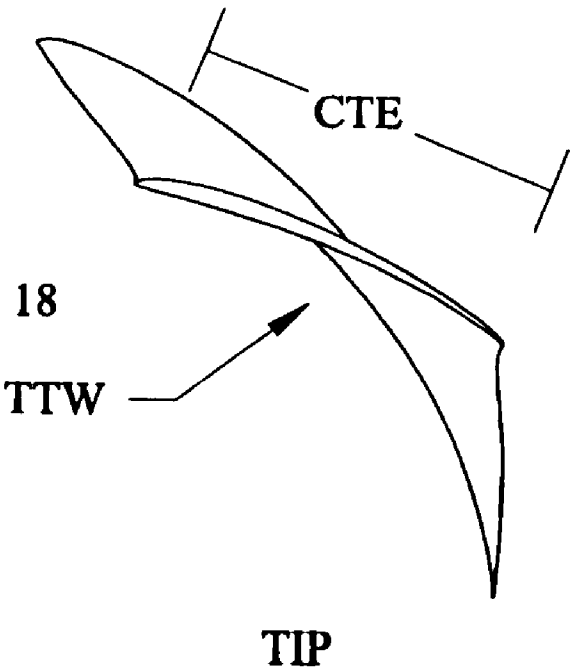
FIG. 10 is a tip end view of the single blade of FIG. 8 along arrow 10A.
Figure 9:
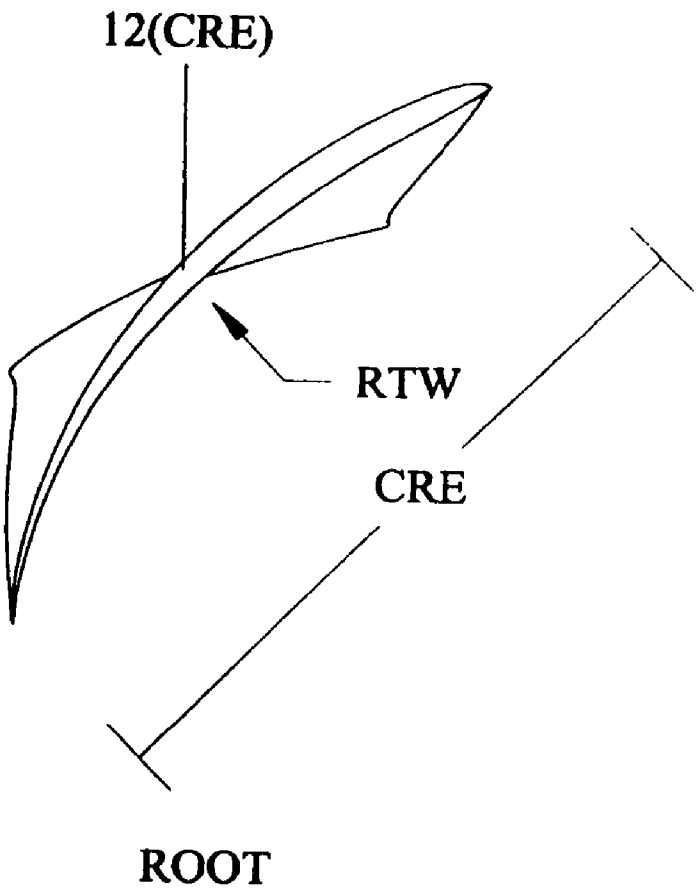
FIG. 9 is a root end view of the single blade of FIG. 8 along arrow 9A.

FIG. 7 is a perspective view of a single twisted condenser blade 10 for the assembly 100 of FIGS. 1-3 for a single blade used in the 19" blade assemblies. FIG. 8 is a top view of a single novel condenser blade 10 of FIG. 7. FIG. 9 is a root end view 12 of the single blade 10 of FIG. 8 along arrow 9A. FIG. 10 is a tip end view 18 of the single blade 10 of FIG. 8 along arrow 10A. Referring to FIGS. 7-10, single twisted blade 10 has a root end 12(CRE) that can be attached to the hub 90 of the preceeding figures, a twisted main body portion 15, and an outer tip end (TE) 18. L refers to the length of the blade 10, RTW refers to root end twist angle in degrees, and TTW refers to the tip twist angle in degrees.

Table 2 shows single blades dimensions for each of the novel blade assemblies, AC-A@, AC-B@, and AC-C@

| Title | Length L Inches | Root Twist RTW degrees | Tip Twist TTW degrees | Root Edge CRE inches | Tip Edge CTE inches |
|---|---|---|---|---|---|
| AC-A@ | 6.25" | 44.9° | 20° | 7.90" | 3.875" |
| AC-B@ | 6.25" | 29.9 | 19.9° | 6.75" | 3.625" |
| AC-C@ | 6.25" | 44.9° | 20° | 7.90" | 3.875" |

Each of the blades AC-A@, AC-B@, and AC-C@ are attached at their root ends to the hub at a greater pitch than the outer tip ends of the blade. For example, the angle of pitch is oriented in the direction of attack(rotation direction) of the blades. Each blade has a width that can taper downward from a greater width at the blade root end to a narrower width at the blade tip end.

Each blade AC-A@, AC-B@, and AC-C@ has a wide root end CRE, with an upwardly facing concaved rounded surface with a large twist on the blade. Along the length of each blade the twist straightens out while the blade width tapers to a narrower width tip end CTE having a smaller blade twist. The tip end CTE can have an upwardly facing concaved triangular surface.

Figure 11:
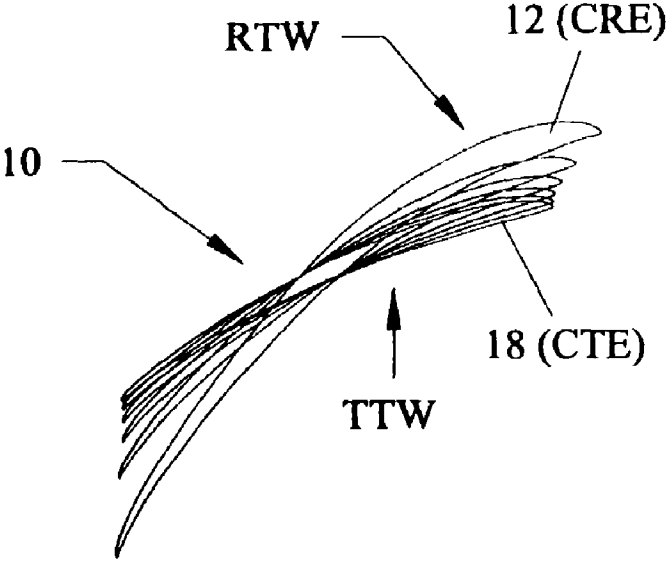
FIG. 11 shows a single condenser blade of FIGS. 7-10 represented by cross-sections showing degrees of twist from the root end to the tip end.

FIG. 11 shows a single condenser blade 10 of FIGS. 7-10 represented by cross-sections showing degrees of twist from the root end RTW and 12(CRE) to the tip end TTW and 18(CTE).

Figure 12:
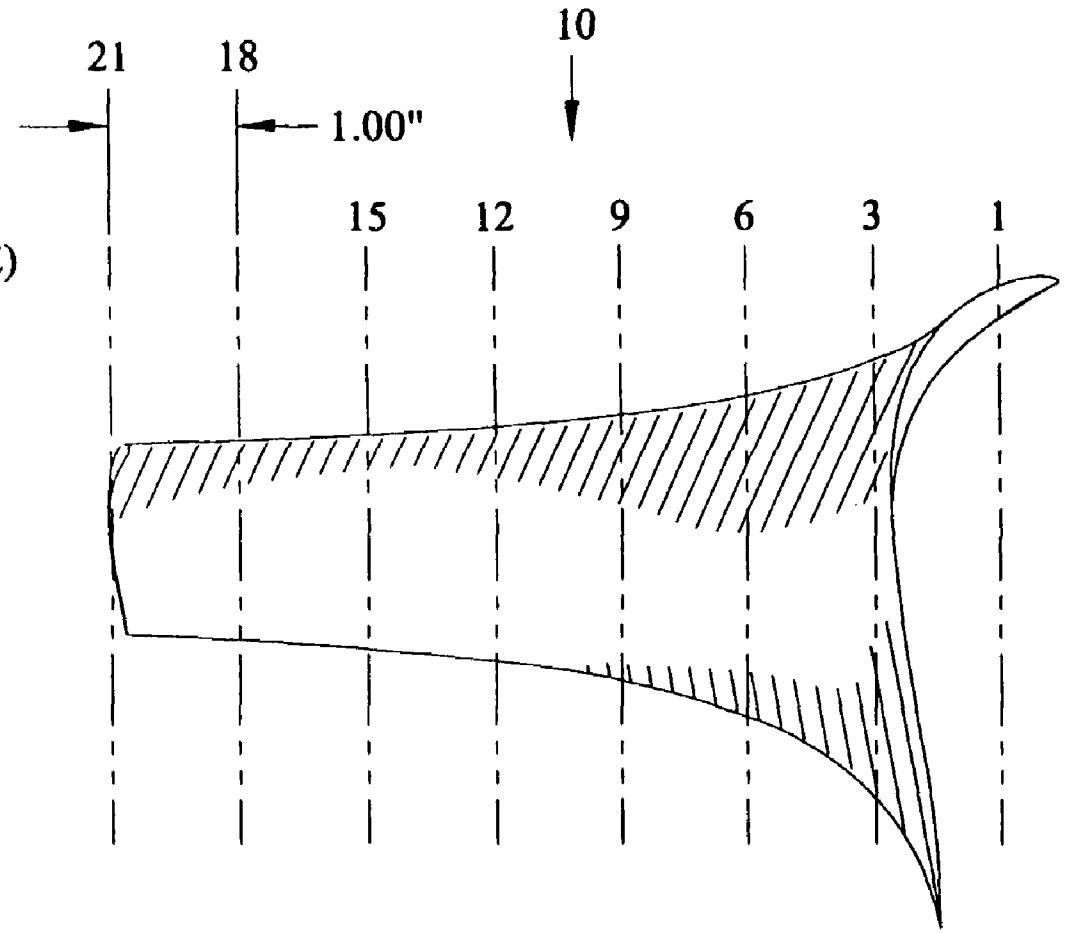
FIG. 12 shows an enlarged side view of the blade of FIG. 10 with section lines spaced approximately 1 inch apart from one another.

FIG. 12 shows an enlarged side view of the blade of FIG. 10 with seven section lines spaced equally apart from one another. Only seven are shown for clarity.

Table 3 shows a blade platform definition along twenty one(21) different station points along the novel small blade AC-A@, and AC-B@ used in the 19" blade assemblies.

TABLE 3

Blade platform definition

| Station | Radius Meters | Chord Meters | Twist Degrees |
|---|---|---|---|
| 1 | 0.0857 | 0.1774 | 47.07 |
| 2 | 0.0935 | 0.1473 | 42.16 |
| 3 | 0.1013 | 0.1326 | 39.15 |
| 4 | 0.1091 | 0.1232 | 36.92 |
| 5 | 0.1168 | 0.1167 | 35.13 |
| 6 | 0.1246 | 0.1118 | 33.63 |
| 7 | 0.1324 | 0.1080 | 32.35 |
| 8 | 0.1402 | 0.1050 | 31.23 |
| 9 | 0.1480 | 0.1027 | 30.23 |
| 10 | 0.1557 | 0.1008 | 29.34 |
| 11 | 0.1635 | 0.0993 | 28.53 |
| 12 | 0.1713 | 0.0980 | 27.79 |
| 13 | 0.1791 | 0.0971 | 27.11 |
| 14 | 0.1868 | 0.0963 | 26.48 |
| 15 | 0.1946 | 0.0957 | 25.90 |
| 16 | 0.2024 | 0.0953 | 25.36 |
| 17 | 0.2102 | 0.0950 | 24.85 |
| 18 | 0.2180 | 0.0948 | 24.37 |
| 19 | 0.2257 | 0.0947 | 23.92 |
| 20 | 0.2335 | 0.0948 | 23.50 |
| 21 | 0.2413 | 0.0949 | 23.10 |

Table 3 summarizes the condenser fan blade geometrics. Since Fan AC-C@ uses the same fan blade as "AC-A@" (but is a 5-blade version) its description is identical.

Slicing the novel 19 inch blade into 21 sections from the root end to the tip end would include X/C and Y/C coordinates.

The following Table 3RP shows the coordinate columns represent the X/C and Y/C coordinates for the root end station portion(where the blades meet the hub) of the novel twisted blades for a 19 inch fan size. These coordinates are given in a non-dimensional format, were x refers to the horizontal position, y refers to the vertical position and c is the chord length between the stations.

TABLE 3RP

X/C and Y/C coordinates for Root End Station
Airfoil coordinates at station 1

| X/C | Y/C |
|---|---|
| 1.00000 | 0.00000 |
| 0.99906 | 0.00187 |
| 0.99622 | 0.00515 |
| 0.99141 | 0.00984 |
| 0.98465 | 0.01536 |
| 0.97598 | 0.02187 |
| 0.96542 | 0.02904 |
| 0.95302 | 0.03690 |
| 0.93883 | 0.04522 |
| 0.92291 | 0.05397 |
| 0.90532 | 0.06297 |
| 0.88612 | 0.07216 |
| 0.86540 | 0.08139 |
| 0.84323 | 0.09058 |
| 0.81970 | 0.09960 |
| 0.79490 | 0.10837 |
| 0.76893 | 0.11677 |
| 0.74188 | 0.12471 |
| 0.71386 | 0.13208 |
| 0.68498 | 0.13881 |
| 0.65535 | 0.14480 |
| 0.62508 | 0.15000 |
| 0.59429 | 0.15433 |
| 0.56310 | 0.15775 |
| 0.53162 | 0.16022 |
| 0.50000 | 0.16170 |
| 0.46835 | 0.16218 |
| 0.43679 | 0.16164 |
| 0.40545 | 0.16009 |
| 0.37447 | 0.15755 |
| 0.34396 | 0.15402 |
| 0.31406 | 0.14957 |
| 0.28489 | 0.14421 |
| 0.25656 | 0.13807 |
| 0.22921 | 0.13116 |
| 0.20293 | 0.12358 |
| 0.17786 | 0.11541 |
| 0.15409 | 0.10671 |
| 0.13173 | 0.09755 |
| 0.11089 | 0.08807 |
| 0.09165 | 0.07833 |
| 0.07408 | 0.06855 |
| 0.05826 | 0.05878 |
| 0.04424 | 0.04927 |
| 0.03207 | 0.04004 |
| 0.02182 | 0.03133 |
| 0.01351 | 0.02308 |
| 0.00718 | 0.01570 |
| 0.00282 | 0.00910 |
| 0.00043 | 0.00394 |
| 0.00000 | 0.00000 |
| 0.00155 | −0.00061 |
| 0.00507 | −0.00014 |
| 0.01054 | 0.00175 |
| 0.01790 | 0.00459 |
| 0.02713 | 0.00854 |
| 0.03815 | 0.01333 |
| 0.05094 | 0.01897 |
| 0.06544 | 0.02521 |
| 0.08159 | 0.03203 |
| 0.09934 | 0.03927 |
| 0.11860 | 0.04689 |
| 0.13930 | 0.05475 |
| 0.16136 | 0.06278 |
| 0.18472 | 0.07082 |
| 0.20928 | 0.07877 |
| 0.23497 | 0.08647 |

TABLE 3RP-continued

| X/C and Y/C coordinates for Root End Station Airfoil coordinates at station 1 | |
|---|---|
| X/C | Y/C |
| 0.26168 | 0.09379 |
| 0.28933 | 0.10065 |
| 0.31782 | 0.10693 |
| 0.34702 | 0.11256 |
| 0.37684 | 0.11747 |
| 0.40717 | 0.12159 |
| 0.43788 | 0.12486 |
| 0.46886 | 0.12722 |
| 0.50000 | 0.12864 |
| 0.53117 | 0.12909 |
| 0.56224 | 0.12857 |
| 0.59309 | 0.12709 |
| 0.62361 | 0.12468 |
| 0.65367 | 0.12135 |
| 0.68314 | 0.11717 |
| 0.71192 | 0.11219 |
| 0.73987 | 0.10647 |
| 0.76690 | 0.10009 |
| 0.79289 | 0.09315 |
| 0.81773 | 0.08573 |
| 0.84132 | 0.07795 |
| 0.86357 | 0.06989 |
| 0.88439 | 0.06171 |
| 0.90370 | 0.05349 |
| 0.92142 | 0.04542 |
| 0.93747 | 0.03754 |
| 0.95181 | 0.03007 |
| 0.96436 | 0.02302 |
| 0.97508 | 0.01666 |
| 0.98393 | 0.01094 |
| 0.99088 | 0.00623 |
| 0.99589 | 0.00241 |
| 0.99896 | 0.00006 |
| 1.00000 | −0.00141 |
| 1.00000 | 0.00141 |

The following Table 3TE shows the coordinate columns representing the X/C and Y/C coordinates for the tip end station section of the 21 sections of the novel twisted 19 inch blades for an approximately 825 rpm running blades. These coordinates are given in a non-dimensional format, were x refers to the horizontal position, y refers to the vertical position and c is the chord length between the stations.

TABLE 3PE

| X/C and Y/C coordinates for Tip End Station Airfoil coordinates at station 21 | |
|---|---|
| X/C | Y/C |
| 1.00000 | 0.00000 |
| 0.99906 | 0.00122 |
| 0.99622 | 0.00330 |
| 0.99141 | 0.00601 |
| 0.98465 | 0.00904 |
| 0.97598 | 0.01243 |
| 0.96542 | 0.01603 |
| 0.95302 | 0.01985 |
| 0.93883 | 0.02376 |
| 0.92291 | 0.02779 |
| 0.90532 | 0.03184 |
| 0.88612 | 0.03590 |
| 0.86540 | 0.03992 |
| 0.84323 | 0.04388 |
| 0.81970 | 0.04776 |
| 0.79490 | 0.05153 |
| 0.76893 | 0.05514 |
| 0.74188 | 0.05858 |
| 0.71386 | 0.06181 |
| 0.68498 | 0.06482 |

TABLE 3PE-continued

| X/C and Y/C coordinates for Tip End Station Airfoil coordinates at station 21 | |
|---|---|
| X/C | Y/C |
| 0.65535 | 0.06756 |
| 0.62508 | 0.07003 |
| 0.59429 | 0.07220 |
| 0.56310 | 0.07405 |
| 0.53162 | 0.07556 |
| 0.50000 | 0.07673 |
| 0.46835 | 0.07752 |
| 0.43679 | 0.07794 |
| 0.40545 | 0.07796 |
| 0.37447 | 0.07759 |
| 0.34396 | 0.07679 |
| 0.31406 | 0.07558 |
| 0.28489 | 0.07395 |
| 0.25656 | 0.07194 |
| 0.22921 | 0.06953 |
| 0.20293 | 0.06674 |
| 0.17786 | 0.06357 |
| 0.15409 | 0.06002 |
| 0.13173 | 0.05608 |
| 0.11089 | 0.05181 |
| 0.09165 | 0.04720 |
| 0.07408 | 0.04236 |
| 0.05826 | 0.03733 |
| 0.04424 | 0.03222 |
| 0.03207 | 0.02704 |
| 0.02182 | 0.02189 |
| 0.01351 | 0.01676 |
| 0.00718 | 0.01187 |
| 0.00282 | 0.00725 |
| 0.00043 | 0.00330 |
| 0.00000 | 0.00000 |
| 0.00155 | −0.00126 |
| 0.00507 | −0.00200 |
| 0.01054 | −0.00208 |
| 0.01790 | −0.00176 |
| 0.02713 | −0.00093 |
| 0.03815 | 0.00028 |
| 0.05094 | 0.00186 |
| 0.06544 | 0.00368 |
| 0.08159 | 0.00576 |
| 0.09934 | 0.00802 |
| 0.11860 | 0.01049 |
| 0.13930 | 0.01312 |
| 0.16136 | 0.01589 |
| 0.18472 | 0.01876 |
| 0.20928 | 0.02167 |
| 0.23497 | 0.02455 |
| 0.26168 | 0.02735 |
| 0.28933 | 0.03004 |
| 0.31782 | 0.03255 |
| 0.34702 | 0.03490 |
| 0.37684 | 0.03705 |
| 0.40717 | 0.03896 |
| 0.43788 | 0.04062 |
| 0.46886 | 0.04199 |
| 0.50000 | 0.04305 |
| 0.53117 | 0.04379 |
| 0.56224 | 0.04418 |
| 0.59309 | 0.04424 |
| 0.62361 | 0.04395 |
| 0.65367 | 0.04331 |
| 0.68314 | 0.04234 |
| 0.71192 | 0.04105 |
| 0.73987 | 0.03943 |
| 0.76690 | 0.03753 |
| 0.79289 | 0.03534 |
| 0.81773 | 0.03289 |
| 0.84132 | 0.03022 |
| 0.86357 | 0.02736 |
| 0.88439 | 0.02436 |
| 0.90370 | 0.02125 |
| 0.92142 | 0.01810 |
| 0.93747 | 0.01494 |
| 0.95181 | 0.01185 |

TABLE 3PE-continued

| X/C and Y/C coordinates for Tip End Station Airfoil coordinates at station 21 | |
|---|---|
| X/C | Y/C |
| 0.96436 | 0.00883 |
| 0.97508 | 0.00602 |
| 0.98393 | 0.00341 |
| 0.99088 | 0.00119 |
| 0.99589 | −0.00066 |
| 0.99896 | −0.00181 |
| 1.00000 | −0.00263 |
| 1.00000 | 0.00263 |

Referring to Tables 3, 3RE and 3TE, there are twenty one(21) stations along the blade length. The column entitled Radius meter includes the distance in meters from the root end of the blade to station 1 (horizontal line across the blade). Column entitled Chord Meters includes the width component of the blade at that particular station. Twist degrees is the pitch of the twist of the blades relative to the hub with the degrees given in the direction of blade rotation.

Using the novel nineteen inch diameter condenser blade assemblies can result in up to an approximately 32% reduction in fan motor power. For example, a current 3-ton AC unit uses ⅛ HP motor drawing 200 W to produce 2500 cfm with stamped metal blades (shown in FIGS. 1-3). The novel nineteen inch diameter twisted blade assemblies can use ⅛ HP motor drawing approximately 130 W to produce similar air flow. The use of the smaller motor has lower cost and offsets added costs of improved fan blades as well as reduce ambient noise levels produced by the condenser. The smaller motor can also have an approximate 2 to approximately 3% increase in overall air conditioner efficiency. The novel blade assemblies can have an average reduction in summer AC peak load of approximately 60 Watt per customers for utilities and up to 100 W when combined with a conical diffuser and an ECM motor. The novel tapered, twisted blades with airfoils results in a more quiet fan operation than the stamped metal blades and the other blades of the prior art.

Table 4 shows a blade platform definition along twenty one(21) different station points along the novel large blade AC-C@ used in the 27.6" blade assemblies.

TABLE 4

| Station | Radius Meters | Chord Meters | Twist Degrees |
|---|---|---|---|
| 1 | 0.0825 | 0.1897 | 30.50 |
| 2 | 0.0959 | 0.1677 | 27.49 |
| 3 | 0.1094 | 0.1457 | 24.48 |
| 4 | 0.1228 | 0.1321 | 22.42 |
| 5 | 0.1361 | 0.1226 | 20.86 |
| 6 | 0.1495 | 0.1156 | 19.61 |
| 7 | 0.1629 | 0.1102 | 18.57 |
| 8 | 0.1763 | 0.1059 | 17.67 |
| 9 | 0.1897 | 0.1023 | 16.90 |
| 10 | 0.2031 | 0.0994 | 16.21 |
| 11 | 0.2165 | 0.0970 | 15.60 |
| 12 | 0.2299 | 0.0949 | 15.05 |
| 13 | 0.2433 | 0.0931 | 14.55 |
| 14 | 0.2567 | 0.0916 | 14.10 |
| 15 | 0.2701 | 0.0903 | 13.68 |
| 16 | 0.2835 | 0.0892 | 13.30 |
| 17 | 0.2969 | 0.0882 | 12.94 |
| 18 | 0.3103 | 0.0874 | 12.61 |
| 19 | 0.3237 | 0.0867 | 12.30 |

TABLE 4-continued

| Station | Radius Meters | Chord Meters | Twist Degrees |
|---|---|---|---|
| 20 | 0.3371 | 0.0861 | 12.01 |
| 21 | 0.3505 | 0.0856 | 11.74 |

Slicing the novel 27.6 inch blade into 21 sections from the root end to the tip end would include X/C and Y/C coordinates. These coordinates are given in a non-dimensional format, were x refers to the horizontal position, y refers to the vertical position and c is the chord length between the stations.

The following Table 4RP shows the coordinate columns represent the X/C and Y/C coordinates for the root end station portion(where the blades meet the hub) of the novel twisted blades for a 27.6 inch fan size.

TABLE 4RP

| X/C, Y/C coordinates for Root End Station Airfoil coordinates at station 1 | |
|---|---|
| X/C | Y/C |
| 1.00000 | 0.00000 |
| 0.99904 | 0.00159 |
| 0.99615 | 0.00455 |
| 0.99130 | 0.00869 |
| 0.98450 | 0.01362 |
| 0.97579 | 0.01939 |
| 0.96520 | 0.02577 |
| 0.95277 | 0.03276 |
| 0.93855 | 0.04016 |
| 0.92260 | 0.04796 |
| 0.90498 | 0.05597 |
| 0.88576 | 0.06416 |
| 0.86501 | 0.07239 |
| 0.84283 | 0.08058 |
| 0.81928 | 0.08864 |
| 0.79448 | 0.09649 |
| 0.76850 | 0.10402 |
| 0.74146 | 0.11113 |
| 0.71345 | 0.11775 |
| 0.68459 | 0.12381 |
| 0.65499 | 0.12923 |
| 0.62477 | 0.13394 |
| 0.59404 | 0.13788 |
| 0.56292 | 0.14103 |
| 0.53153 | 0.14332 |
| 0.50000 | 0.14475 |
| 0.46845 | 0.14528 |
| 0.43702 | 0.14492 |
| 0.40581 | 0.14365 |
| 0.37497 | 0.14151 |
| 0.34461 | 0.13847 |
| 0.31485 | 0.13461 |
| 0.28582 | 0.12993 |
| 0.25764 | 0.12455 |
| 0.23042 | 0.11848 |
| 0.20427 | 0.11180 |
| 0.17930 | 0.10458 |
| 0.15561 | 0.09686 |
| 0.13332 | 0.08872 |
| 0.11251 | 0.08025 |
| 0.09326 | 0.07153 |
| 0.07565 | 0.06273 |
| 0.05976 | 0.05394 |
| 0.04564 | 0.04533 |
| 0.03334 | 0.03697 |
| 0.02293 | 0.02902 |
| 0.01443 | 0.02148 |
| 0.00788 | 0.01466 |
| 0.00329 | 0.00857 |
| 0.00066 | 0.00371 |
| 0.00000 | 0.00000 |

TABLE 4RP-continued

| X/C, Y/C coordinates for Root End Station Airfoil coordinates at station 1 | |
|---|---|
| X/C | Y/C |
| 0.00131 | −0.00094 |
| 0.00460 | −0.00085 |
| 0.00983 | 0.00045 |
| 0.01699 | 0.00265 |
| 0.02602 | 0.00583 |
| 0.03688 | 0.00980 |
| 0.04953 | 0.01455 |
| 0.06393 | 0.01986 |
| 0.08002 | 0.02572 |
| 0.09772 | 0.03198 |
| 0.11698 | 0.03861 |
| 0.13771 | 0.04549 |
| 0.15984 | 0.05255 |
| 0.18328 | 0.05965 |
| 0.20795 | 0.06671 |
| 0.23376 | 0.07356 |
| 0.26061 | 0.08010 |
| 0.28840 | 0.08625 |
| 0.31702 | 0.09188 |
| 0.34638 | 0.09697 |
| 0.37634 | 0.10141 |
| 0.40680 | 0.10516 |
| 0.43765 | 0.10817 |
| 0.46876 | 0.11037 |
| 0.50000 | 0.11174 |
| 0.53126 | 0.11224 |
| 0.56242 | 0.11189 |
| 0.59335 | 0.11069 |
| 0.62392 | 0.10865 |
| 0.65402 | 0.10580 |
| 0.68353 | 0.10219 |
| 0.71233 | 0.09786 |
| 0.74030 | 0.09288 |
| 0.76733 | 0.08732 |
| 0.79331 | 0.08125 |
| 0.81814 | 0.07475 |
| 0.84172 | 0.06792 |
| 0.86395 | 0.06086 |
| 0.88475 | 0.05368 |
| 0.90404 | 0.04647 |
| 0.92173 | 0.03938 |
| 0.93776 | 0.03248 |
| 0.95206 | 0.02592 |
| 0.96458 | 0.01977 |
| 0.97527 | 0.01420 |
| 0.98408 | 0.00923 |
| 0.99099 | 0.00513 |
| 0.99596 | 0.00187 |
| 0.99898 | −0.00014 |
| 1.00000 | −0.00132 |
| 1.00000 | 0.00132 |

The following Table 4TE shows the coordinate columns representing the X/C and Y/C coordinates for the tip end station section of the 21 sections of the novel twisted 27.6 inch blades for an approximately 825 rpm running blades. These coordinates are given in a non-dimensional format, were x refers to the horizontal position, y refers to the vertical position and c is the chord length between the stations.

TABLE 4PE

| X/C and Y/C coordinates for Tip End Station Airfoil coordinates at station 21 | |
|---|---|
| X/C | Y/C |
| 1.00000 | 0.00000 |
| 0.99904 | 0.00073 |
| 0.99615 | 0.00216 |
| 0.99130 | 0.00391 |

TABLE 4PE-continued

| X/C and Y/C coordinates for Tip End Station Airfoil coordinates at station 21 | |
|---|---|
| X/C | Y/C |
| 0.98450 | 0.00586 |
| 0.97579 | 0.00801 |
| 0.96520 | 0.01029 |
| 0.95277 | 0.01268 |
| 0.93855 | 0.01515 |
| 0.92260 | 0.01768 |
| 0.90498 | 0.02023 |
| 0.88576 | 0.02279 |
| 0.86501 | 0.02534 |
| 0.84283 | 0.02788 |
| 0.81928 | 0.03038 |
| 0.79448 | 0.03283 |
| 0.76850 | 0.03522 |
| 0.74146 | 0.03753 |
| 0.71345 | 0.03973 |
| 0.68459 | 0.04182 |
| 0.65499 | 0.04378 |
| 0.62477 | 0.04559 |
| 0.59404 | 0.04724 |
| 0.56292 | 0.04872 |
| 0.53153 | 0.05001 |
| 0.50000 | 0.05110 |
| 0.46845 | 0.05197 |
| 0.43702 | 0.05261 |
| 0.40581 | 0.05301 |
| 0.37497 | 0.05316 |
| 0.34461 | 0.05302 |
| 0.31485 | 0.05261 |
| 0.28582 | 0.05191 |
| 0.25764 | 0.05094 |
| 0.23042 | 0.04969 |
| 0.20427 | 0.04815 |
| 0.17930 | 0.04631 |
| 0.15561 | 0.04416 |
| 0.13332 | 0.04167 |
| 0.11251 | 0.03888 |
| 0.09326 | 0.03579 |
| 0.07565 | 0.03246 |
| 0.05976 | 0.02892 |
| 0.04564 | 0.02525 |
| 0.03334 | 0.02148 |
| 0.02293 | 0.01763 |
| 0.01443 | 0.01373 |
| 0.00788 | 0.00988 |
| 0.00329 | 0.00619 |
| 0.00066 | 0.00284 |
| 0.00000 | 0.00000 |
| 0.00131 | −0.00180 |
| 0.00460 | −0.00324 |
| 0.00983 | −0.00434 |
| 0.01699 | −0.00514 |
| 0.02602 | −0.00560 |
| 0.03688 | −0.00574 |
| 0.04953 | −0.00560 |
| 0.06393 | −0.00525 |
| 0.08002 | −0.00468 |
| 0.09772 | −0.00392 |
| 0.11698 | −0.00295 |
| 0.13771 | −0.00177 |
| 0.15984 | −0.00041 |
| 0.18328 | 0.00110 |
| 0.20795 | 0.00272 |
| 0.23376 | 0.00440 |
| 0.26061 | 0.00608 |
| 0.28840 | 0.00776 |
| 0.31702 | 0.00938 |
| 0.34638 | 0.01096 |
| 0.37634 | 0.01246 |
| 0.40680 | 0.01387 |
| 0.43765 | 0.01516 |
| 0.46876 | 0.01630 |
| 0.50000 | 0.01728 |
| 0.53126 | 0.01808 |
| 0.56242 | 0.01868 |

TABLE 4PE-continued

| X/C and Y/C coordinates for Tip End Station Airfoil coordinates at station 21 | |
|---|---|
| X/C | Y/C |
| 0.59335 | 0.01909 |
| 0.62392 | 0.01930 |
| 0.65402 | 0.01930 |
| 0.68353 | 0.01910 |
| 0.71233 | 0.01870 |
| 0.74030 | 0.01809 |
| 0.76733 | 0.01730 |
| 0.79331 | 0.01632 |
| 0.81814 | 0.01517 |
| 0.84172 | 0.01387 |
| 0.86395 | 0.01243 |
| 0.88475 | 0.01089 |
| 0.90404 | 0.00928 |
| 0.92173 | 0.00763 |
| 0.93776 | 0.00596 |
| 0.95206 | 0.00432 |
| 0.96458 | 0.00273 |
| 0.97527 | 0.00125 |
| 0.98408 | −0.00010 |
| 0.99099 | −0.00124 |
| 0.99596 | −0.00211 |
| 0.99898 | −0.00260 |
| 1.00000 | −0.00292 |
| 1.00000 | 0.00292 |

Figure 13:
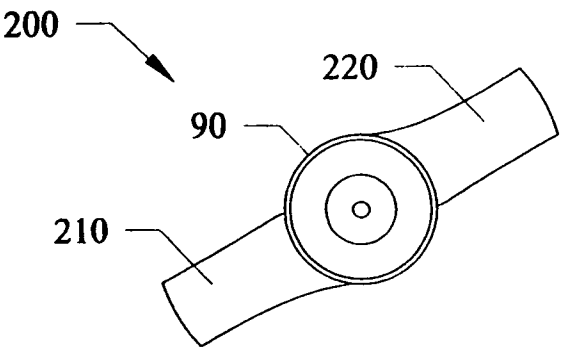
FIG. 13 is a bottom view of a second preferred embodiment of a two condenser blade assembly.

FIG. 13 is a bottom view of a second preferred embodiment of a two condenser blade assembly 200. Here two twisted blades 210, 220 each similar to the ones shown in FIGS. 7-12 can be mounted on opposite sides of a hub 90, and being approximately 180 degrees from one another.

Figure 14:
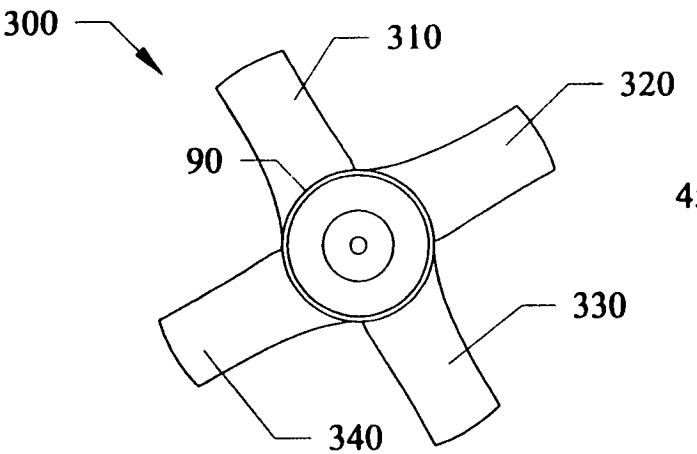
FIG. 14 is a bottom view of a third preferred embodiment of a four condenser blade assembly.

FIG. 14 is a bottom view of a third preferred embodiment of a four condenser blade assembly 300. Here four twisted blades 310, 320, 330, 340 each similar to the ones shown in FIGS. 7-12 can be equally spaced apart from one another (approximately 90 degrees to one another) while mounted to a hub 90.

Figure 15:
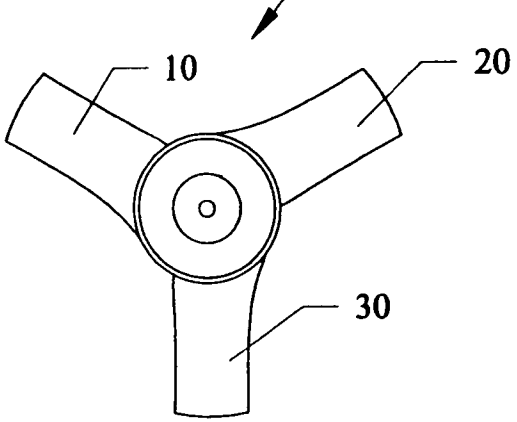
FIG. 15 is a bottom view of the three condenser blade assembly of FIGS. 4-8.

FIG. 15 is a bottom view of the three condenser blade assembly 100 of FIGS. 4-8 with three blades 10, 20, and 30 previously described.

Figure 16:
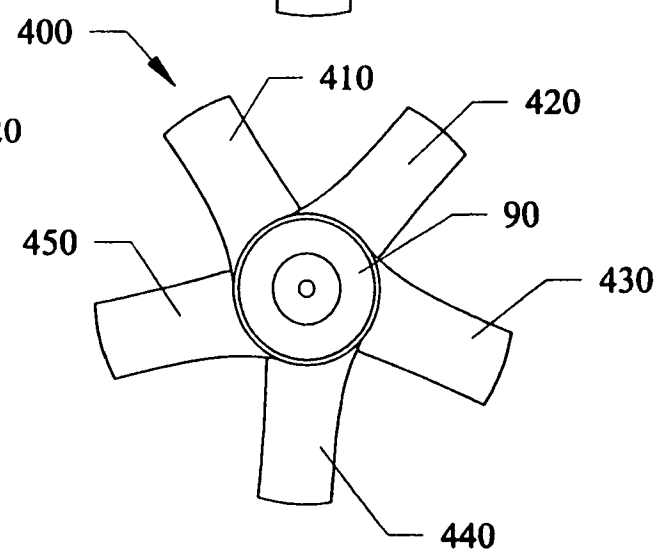
FIG. 16 is a bottom view of a fourth preferred embodiment of a five condenser blade assembly.

FIG. 16 is a bottom view of a fourth preferred embodiment of a five condenser blade assembly 400. Here, five twisted blades 410, 420, 430, 440 and 45 each similar to the ones shown in FIGS. 7-12 can be equally spaced apart from one another(approximately 72 degrees to one another) while mounted to hub 90.

Figure 17:
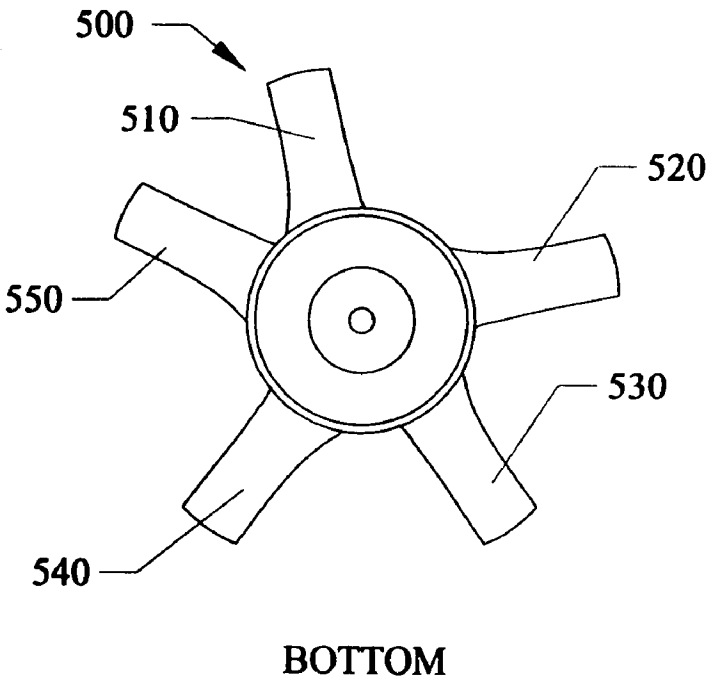
FIG. 17 is a bottom view of a fifth preferred embodiment of an assymetrical configuration of a five condenser blade assembly.

FIG. 17 is a bottom view of a fifth preferred embodiment of an asymmetrical configuration of a five condenser blade assembly 500. For this asymmetrical embodiment, the novel twisted blades of the condenser fan are not equally spaced apart from one another. This novel asymmetrical spacing produces a reduced noise level around the AC condenser. This technology has been previously developed for helicopter rotors, but never for air conditioner condenser fan design. See for example, Kernstock, Nicholas C., Rotor & Wing, Slashing Through the Noise Barrier, August, 1999, *Defense Daily Network*, cover story, pages 1-11.

Figure 18:
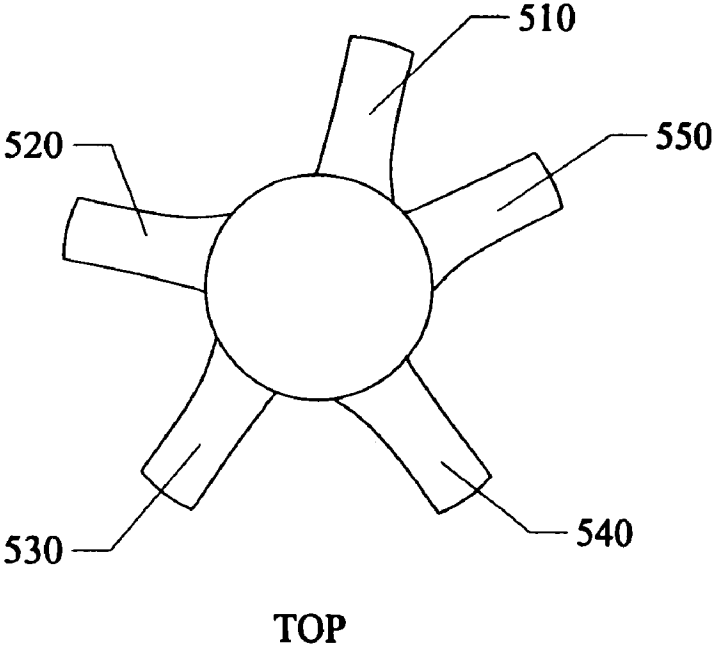
FIG. 18 is a top view of the assymetrical configuration blade assembly of FIG. 17.

In the novel embodiment of FIGS. 17-18, the sound of air rushing through an evenly spaced fan rotor creates a resonance frequency with the compressor=s hum, causing a loud drone. But if the blades are not equally spaced, this resonance is significantly reduced producing lower ambient sound levels. With the invention, this is accomplished using a five-bladed fan design where the fan blades are centered unevenly around the rotating motor hub. Table 5 describes the center line blade locations on the 360 degree hub for the asymmetrical configuration.

TABLE 5

| Asymmetrical Fan Blade Locations | |
|---|---|
| Blade Number | Degree of center-line around hub |
| #510 | 79.0117 |
| #520 | 140.1631 |
| #530 | 211.0365 |
| #540 | 297.2651 |
| #550 | 347.4207 |

Comparative measurement of fan noise showed that the asymmetrical blade arrangement can reduce ambient noise levels by approximately 1 decibel (dB) over a symmetrical arrangement.

Figures 19, 20, 21:
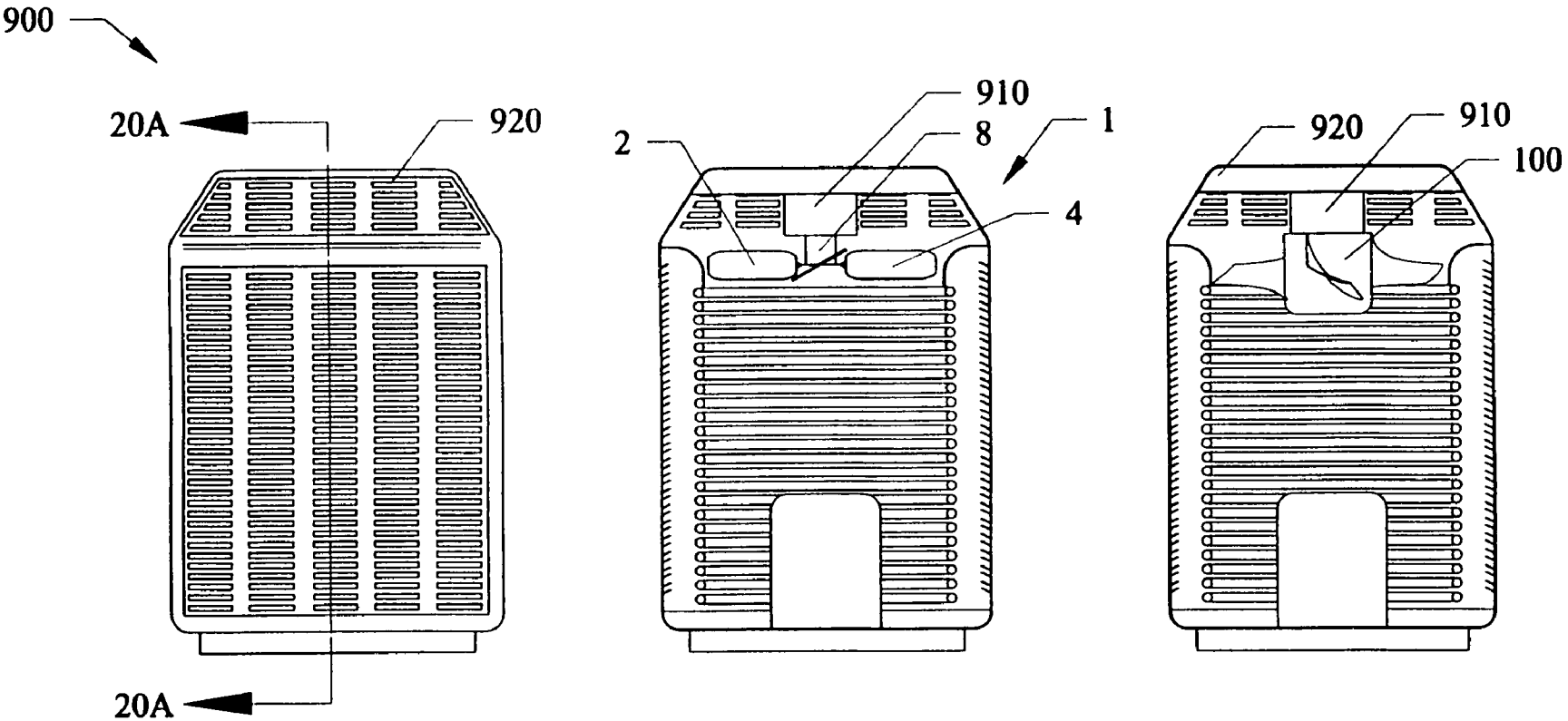
FIG. 19 (PRIOR ART)
FIG. 20 (PRIOR ART)
FIG. 21 (PRIOR ART)
FIG. 19 is a side view of a prior art commercial outdoor air conditioning compressor unit using the prior art condenser fan blades of FIGS. 1-3.
FIG. 20 is a cross-sectional interior view of the prior art commercial air conditioning compressor unit along arrows 20A of FIG. 19 showing the prior art blades of FIGS. 1-3.
FIG. 21 is a cross-sectional interior view of the compressor unit containing the novel condenser blade assemblies of the preceeding figures.

FIG. 19 is a side view of a prior art commercial outdoor air conditioning compressor unit 900 using the prior art condenser fan blades 2, 4, 6 of FIGS. 1-3. FIG. 20 is a cross-sectional interior view of the prior art commercial air conditioning compressor unit 900 along arrows 20A of FIG. 19 showing the prior art blades 2, 4 of FIGS. 1-3, attached to a base for rotating hub portion 8.

FIG. 21 is a cross-sectional interior view of the compressor unit 900 containing the novel condenser blade assemblies 100, 200, 300, 400, 500 of the preceeding figures. The novel invention embodiments 100-500 can be mounted by their hub portion to the existing base under a grill lid portion 920.

In addition, the invention can be used with improved enhancements to the technology (diffusers) as well as a larger fans for high-efficiency of heat pumps. In tests conducted, specifically designed conical diffusers were shown to improve air moving performance of the 19" blade assemblies at approximately 840 rpm from approximately 2210 cfm with a standard top to approximately 2600 cfm with the diffuser—and increase in efficiency of 18%. In addition, the invention can be used with variable speed ECM motors for further condenser fan power savings. This combination can provide both greater savings (over 100 Watts) and lower outdoor unit sound levels which are highly desirable for consumers.

Figure 23:
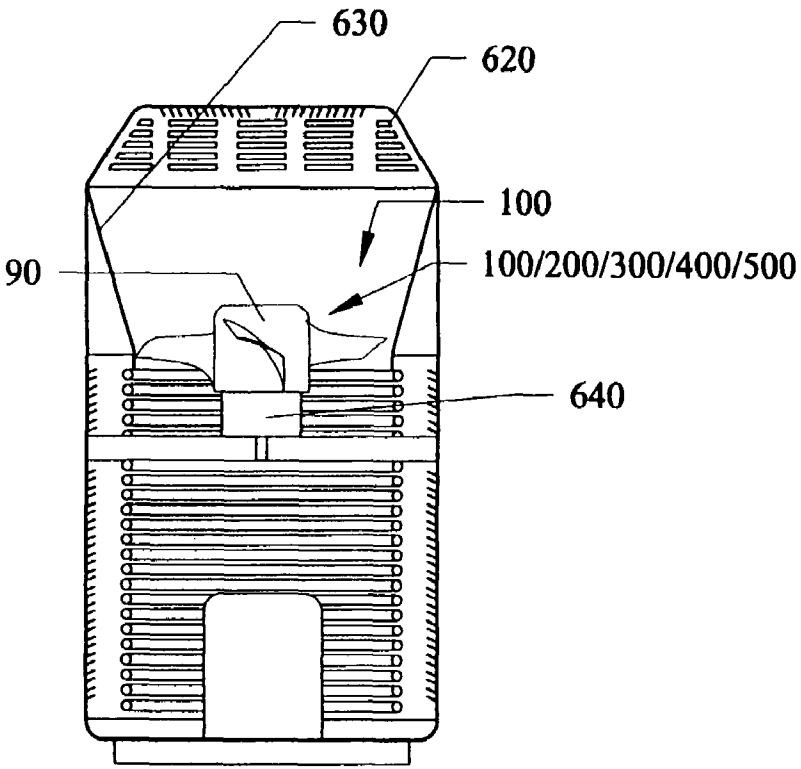
FIG. 23 is a cross-sectional interior view of the diffuser housing inside the compressor unit of FIG. 22 along arrows 23A.
Figure 22:
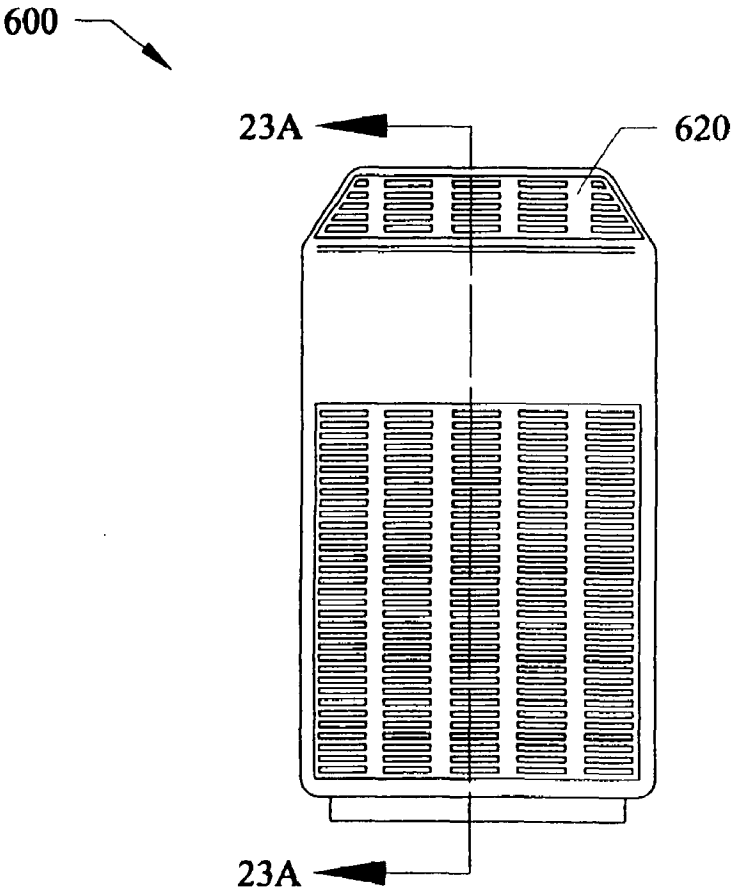
FIG. 22 is a side view of a preferred embodiment of an outdoor air conditioning compressor unit with modified diffuser housing.

FIG. 22 is a side view of a preferred embodiment of an outdoor air conditioning compressor unit 600 with nodified diffuser housing having a conical interior walls 630. FIG. 23 is a cross-sectional interior view of the diffuser housing interior conical walls 630 inside the compressor unit 600 of FIG. 22 along arrows 23A.

FIGS. 22-23 shows a novel diffuser interior walls 630 for use with a condenser unit 600 having a domed top grill 620 above a hub 90 attached to blades 100, and the motor 640 beneath the hub 90. The upwardly expanding surface 630 of the conical diffuser allows for an enhanced airflow out through the dome shaped grill 620 of the condenser unit 600 reducing any backpressure that can be caused with existing systems. This occurs to the drop in air velocity before it reaches the grill assembly 620. Dome shaped grillwork 620 further reduces fan back pressure and reduces accumulation of leaves, and the like.

Figure 24:
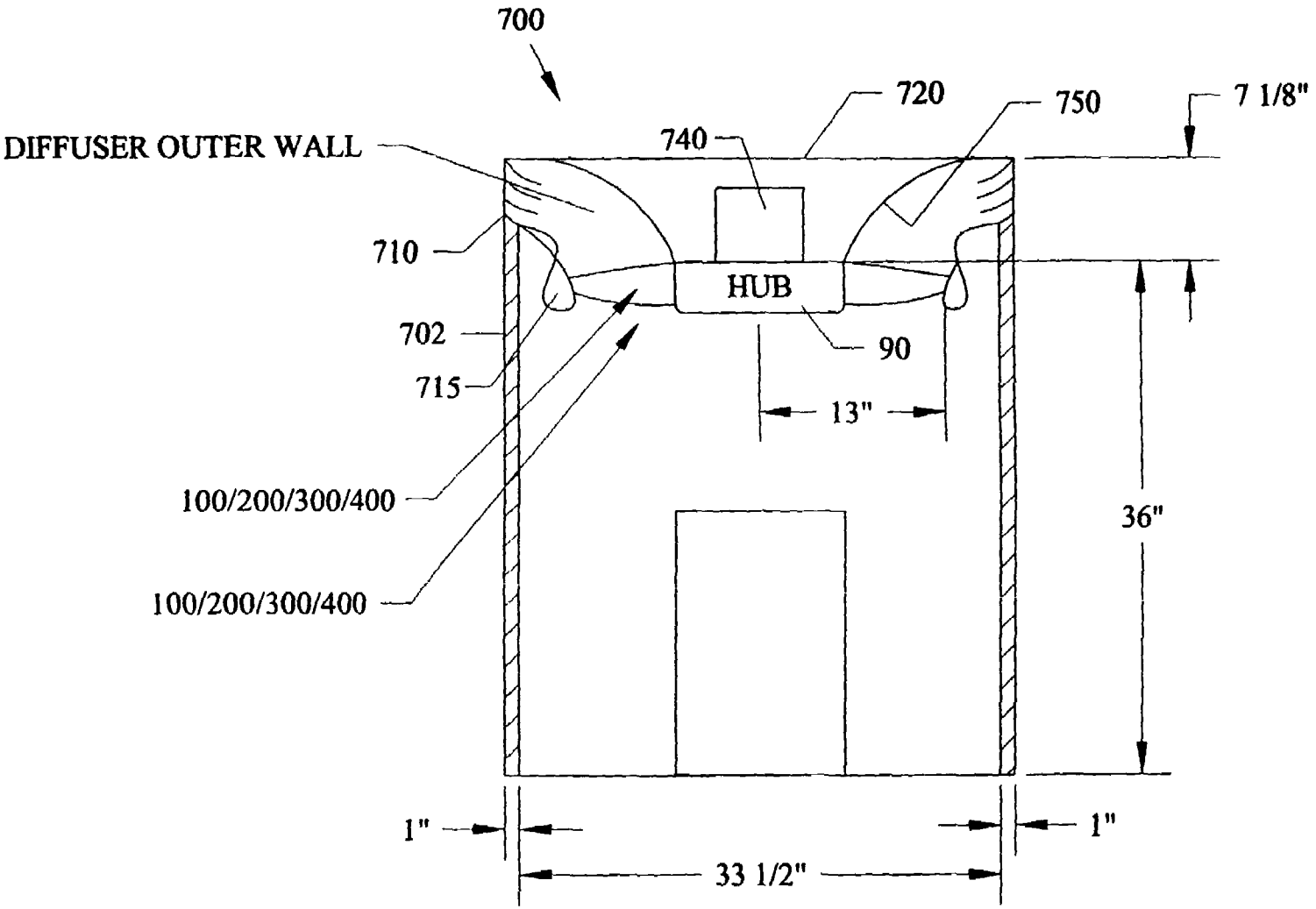
FIG. 24 is a cross-sectional interior view of another embodiment of the novel diffuser housing inside the compressor unit of FIG. 22 along arrows 23A.

FIG. 24 is a cross-sectional interior view of another embodiment of the novel diffuser housing inside the compressor unit of FIG. 22 along arrows 23A. FIG. 24 shows another preferred arrangement 700 of using the novel condenser fan blade assemblies 100/200/300/400 of the preceeding figures with novel curved diffuser side walls 750. FIG. 24 shows the use of a condenser having a flat closed top 720 with upper outer edge vents 710 about the unit 700, and a motor 740 above a hub 90 that is attached to fan blades 100/200/300/400. Here, the bottom edge of an inlet flap 715 is adjacent to and close to the outer edge tip of the blades 100/200/300/400. The motor housing includes novel concave curved side walls 750 which help direct the airflow upward and to the outer edge side vents 710 of the unit 700. Additional convex curved sidewalls 710-715 on a housing interior outer side wall 702 also direct airflow out to the upper edge side vents 710. The combined curved side walls 750 of the motor housing the curved housing outer interior sidewalls function as a diffuser to help direct airflow. Here, exit areas are larger in size than the inlet areas resulting in no air backpressure from using the novel arrangement.

The novel diffuser and condenser unit 600 of FIGS. 22-24 can be used with any of the preceeding novel embodiments 100, 200, 300, 400, 500 previously described.

Although the invention describes embodiments for air conditioner condenser systems, the invention can be used with blades for heat pumps, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of operating an conditioner condenser or heat pump blades, comprising the steps of:

providing asymmetrical twisted blades about a rotatable hub in a housing;

providing a first blade at 79.0117 degrees from a center-line about the hub, each blade having a root end and a tip end and a continuous twist therebetween, each of the twisted blades having a root end angle of twist that is greater than a tip end angle of twist;

providing an approximately 7 degree divergent conical diffuser in the housing above the blades;

rotating the blades at up to approximately 840 rpm;

requiring power from a motor of up to approximately 110 Watts while running the blades and generating the axial airflow; and generating an upward axial airflow from the rotating blades up to approximately 2200 cfm (cubic feet per minute) which diverges outward from the conical diffuser.

2. The method of claim 1, wherein the plurality of asymmetrical blades includes: five asymmetrical blades.

3. The method of claim 2, wherein the five asymmetrical blades includes:

providing a first blade at 79.0117 degrees from a center-line about the hub;

providing a second blade at 140.1631 degrees from a center-line about the hub;

providing a third blade at 211.0365 degrees from a center-line about the hub;

providing a fourth blade at 297.2651 degrees from a center-line about the hub; and providing a fifth blade at 347.4207 degrees from a center-line about the hub.

4. A method of operating air conditioner condenser or heat pump blades, comprising the steps of:

providing five asymmetrical blades about a rotatable hub in a housing;

providing a first blade at 79.0117 degrees from a center-line about the hub;

providing a second blade at 140.1631 degrees from a center-line about the hub;

providing a third blade at 211.0365 degrees from a center-line about the hub;

providing a fourth blade at 297.2651 degrees from a center-line about the hub; and providing a fifth blade at 347.4207 degrees from a center-line about the hub;

providing a divergent conical diffuser in the housing above the blades;

rotating the blades at a selected rpm; and generating an upward axial airflow from the rotating blades at a selected cfm(cubic feet per minute) which diverges outward from the conical diffuser, wherein rotating the blades in the asymmetrical configuration reduces ambient noise levels over a symmetrical arrangement of blades.

5. The method of claim 4, wherein the step of providing the blades includes the step of:

providing twisted blades.

6. The method of claim 5, wherein each of the twisted blades has a root end and a tip end with a continuous twist therebetween, the root end of each blade having a greater angle of twist than the tip end of each blade.

7. A fan assembly for an air conditioner condenser or a heat pump, comprising:

a housing;

a rotatable hub mounted inside of the housing; and five blades mounted in an asymmetrical configuration to the hub, a first blade at 79.0117 degrees from a center-line about the hub;

a second blade at 140.1631 degrees from a center-line about the hub;

a third blade at 211.0365 degrees from a center-line about die hub;

a fourth blade at 297.2651 degrees from a center-line about the hub; and a fifth blade at 347.4207 degrees from a center-line about the hub, wherein rotating the blades in the asymmetrical configuration reduces ambient noise levels over a symmetrical arrangement of blades.

8. The assembly of claim 7, wherein the blades include: twisted blades.

* * * * *